US012117259B2

(12) United States Patent
Litzie et al.

(10) Patent No.: US 12,117,259 B2
(45) **Date of Patent: *Oct. 15, 2024**

(54) BUFFER ASSEMBLY

(71) Applicant: Unrivaled Armory LLC, Henderson, NV (US)

(72) Inventors: Kyle Jeffrey Litzie, Simi Valley, CA (US); Zachary Grey Smith, Coarsegold, CA (US)

(73) Assignee: Unrivaled Armory LLC, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/197,583

(22) Filed: May 15, 2023

(65) Prior Publication Data

US 2023/0304765 A1 Sep. 28, 2023

Related U.S. Application Data

(63) Continuation of application No. 17/575,813, filed on Jan. 14, 2022, now Pat. No. 11,692,785.

(51) Int. Cl.

| | |
|---|---|
| ***F41A 25/12*** | (2006.01) |
| ***F41A 3/82*** | (2006.01) |
| ***F41C 23/06*** | (2006.01) |

(52) U.S. Cl.

CPC ..... *F41A 25/12* (2013.01); *F41A 3/82* (2013.01); *F41C 23/06* (2013.01)

(58) Field of Classification Search

CPC ..... F41A 3/78; F41A 3/80; F41A 3/82; F41A 3/84; F41A 3/86; F41A 3/88; F41A 3/94

See application file for complete search history.

(56) References Cited

U.S. PATENT DOCUMENTS

| | | | | |
|---|---|---|---|---|
| 3,366,011 | A * | 1/1968 | Sturtevant | F41A 3/70 89/198 |
| 3,492,749 | A * | 2/1970 | Vironda | F41C 23/06 42/74 |
| 9,080,823 | B1 * | 7/2015 | Mantas | F41A 3/84 |
| 9,341,437 | B1 * | 5/2016 | Huang | F41A 3/84 |
| 10,054,378 | B2 * | 8/2018 | Pawlowski | F41A 3/84 |
| 10,619,955 | B2 * | 4/2020 | Wyssen | F41A 5/02 |
| 2006/0048637 | A1 * | 3/2006 | Dimitrios | F41A 3/86 42/74 |
| 2010/0122482 | A1 * | 5/2010 | Simms | F41C 23/14 42/1.06 |
| 2013/0319217 | A1 * | 12/2013 | Gangl | F41A 3/84 89/198 |
| 2014/0059909 | A1 * | 3/2014 | Caudle | F41A 3/84 42/1.06 |
| 2017/0205164 | A1 * | 7/2017 | Cassels | F41A 3/84 |
| 2019/0017765 | A1 * | 1/2019 | Bender | F41A 19/44 |
| 2019/0383571 | A1 * | 12/2019 | Wyssen | F41A 3/82 |
| 2021/0025665 | A1 * | 1/2021 | Kincel | F41A 3/84 |
| 2021/0102768 | A1 * | 4/2021 | Perez | F41A 3/84 |
| 2021/0164742 | A1 * | 6/2021 | Snyder | F16F 15/03 |

* cited by examiner

*Primary Examiner* — Gabriel J. Klein

(57) ABSTRACT

A buffer assembly is disclosed. The buffer assembly contains a buffer body, one or more magnets positioned along the buffer body, a hammer, a first spring, a spring guide, and an end cap removably coupled with the spring guide.

9 Claims, 19 Drawing Sheets

BUFFER ASSEMBLY

CROSS REFERENCE TO RELATED APPLICATIONS

This application is a continuation of U.S. patent application Ser. No. 17/575,813 titled "Buffer Assembly" filed Jan. 14, 2022, now issued US Patent No. which is incorporated herein by reference in its entirety.

FIELD

The present invention relates to firearms. More particularly, the present invention relates to a buffer assembly for a firearm.

BACKGROUND

The traditional M16/AR15 buffer has free floating weight inside the buffer which can cause a dead-blow effect. Because this weight is free floating, its position varies the moment the gun is fired which results in inconsistent recoil impulse. The distance the weight travels is relatively short, requiring more weight to get a dead-blow effect. This can decrease the reliability of the firearm.

Therefore, improvements in a buffer mechanism for a firearm are needed.

Figure 1:
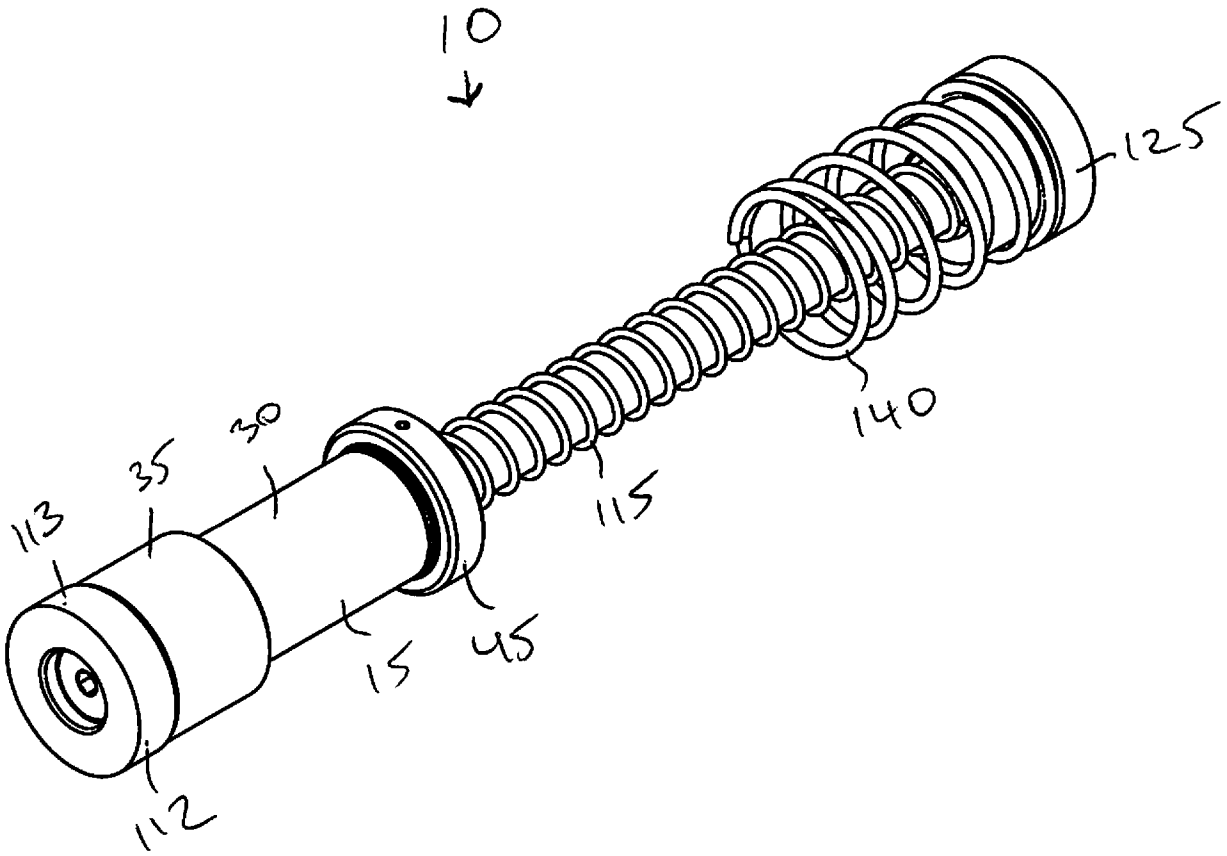
FIG. 1 depicts a buffer assembly according to some embodiments presently disclosed.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

As described herein, the term "pivotally connected" shall be used to describe a situation wherein two or more identified objects are joined together in a manner that allows one or both of the objects to pivot, and/or rotate about or in relation to the other object in either a horizontal or vertical manner.

As described herein, the term "removably coupled" and derivatives thereof shall be used to describe a situation wherein two or more objects are joined together in a non-permanent manner so as to allow the same objects to be repeatedly joined and separated.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that the specific mechanical configurations illustrated in the drawings are intended to exemplify embodiments of the invention and that other alternative mechanical configurations are possible.

Figure 2:
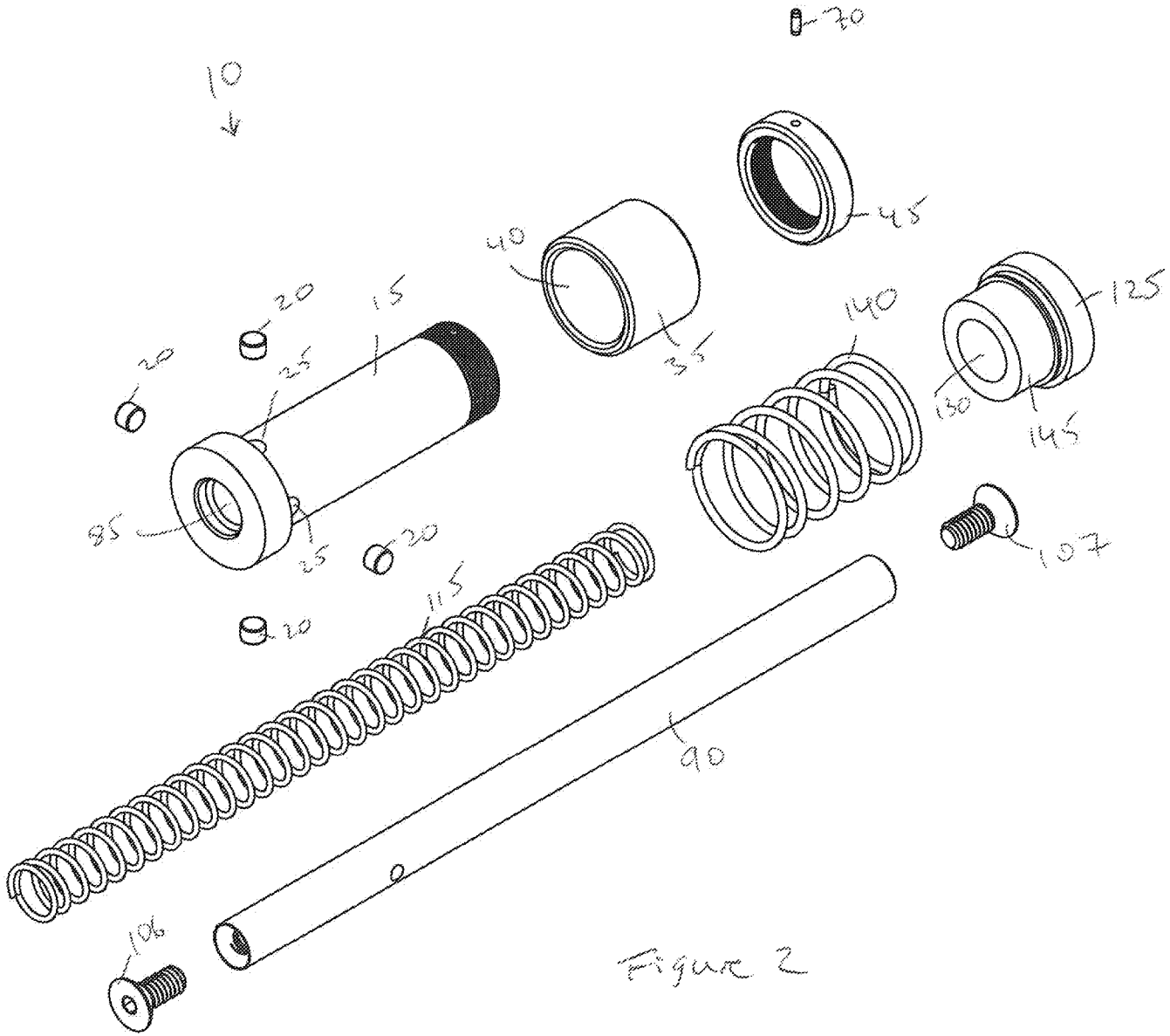
FIG. 2 depicts an exploded view of the buffer assembly according to some embodiments presently disclosed.
Figure 3:
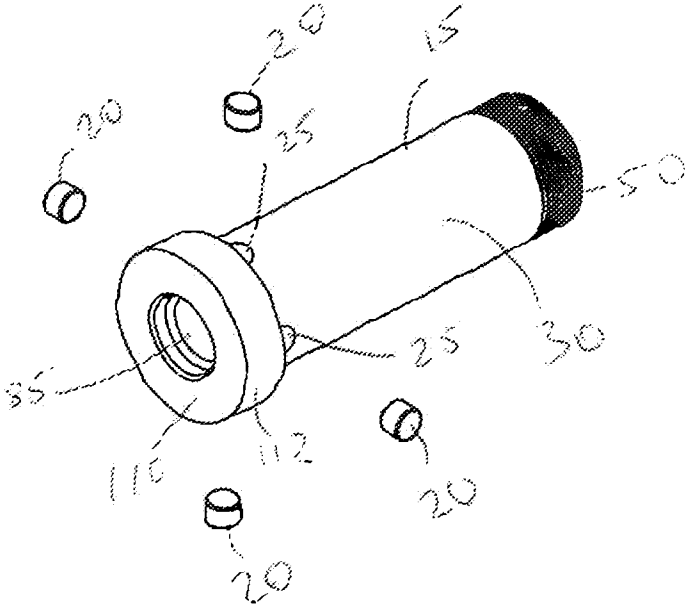
FIG. 3 depicts a portion of the buffer assembly according to some embodiments presently disclosed.

Referring to FIG. 1, a buffer assembly 10 is shown according to some embodiments presently disclosed. FIG. 2 depicts an exploded view of the buffer assembly 10. The buffer assembly 10 may comprise a buffer body 15 and one or more magnets 20. According to some embodiments, the one or more magnets 20 are coupled with the buffer body 15. According to some embodiments, the one or more magnets 20 are removably coupled with the buffer body 15.

Figure 4:
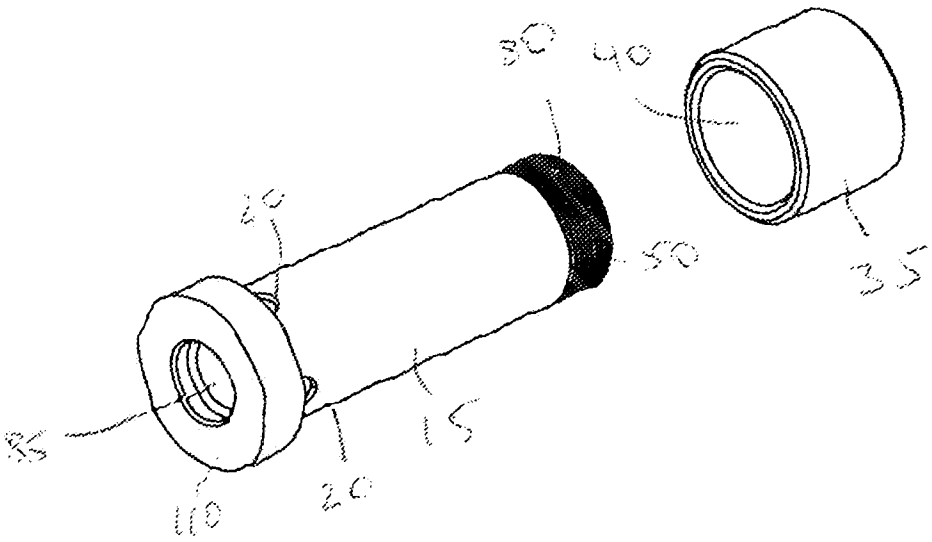
FIG. 4 depicts another portion of the buffer assembly according to some embodiments presently disclosed.

The buffer body 15 comprises an outer surface 30. The one or more magnets 20 may be spaced equidistantly from each other along the outer surface 30. The buffer body 15 may comprise one or more apertures 25 positioned along the outer surface 30. The one or more apertures 25 are configured to accommodate the one or more magnets 20 as shown in FIG. 4. The one or more apertures 25 may be spaced equidistantly from each other along the outer surface 30. According to some embodiment, once placed in the one or more apertures 25, upper surfaces of the one or more magnets 20 are positioned flush with the outer surface 30. According to some embodiment, once placed in the one or more apertures 25, the one or more magnets 20 are positioned below the outer surface 30.

According to some embodiments, the one or more magnets 20 are retained in the one or more apertures 25 using magnetic force. According to some embodiments, the buffer body 15 comprises metal material and is magnetically coupled with the one or more magnets 20. According to some embodiments, the one or more magnets 20 are retained in the one or more apertures 25 using adhesive and/or bonding. According to some embodiments, the one or more magnets 20 are retained in the one or more apertures 25 using interference and/or press fit. According to some embodiments, the buffer body 15 comprises non-metallic material and is adhesively coupled with the one or more magnets 20.

Figure 5:
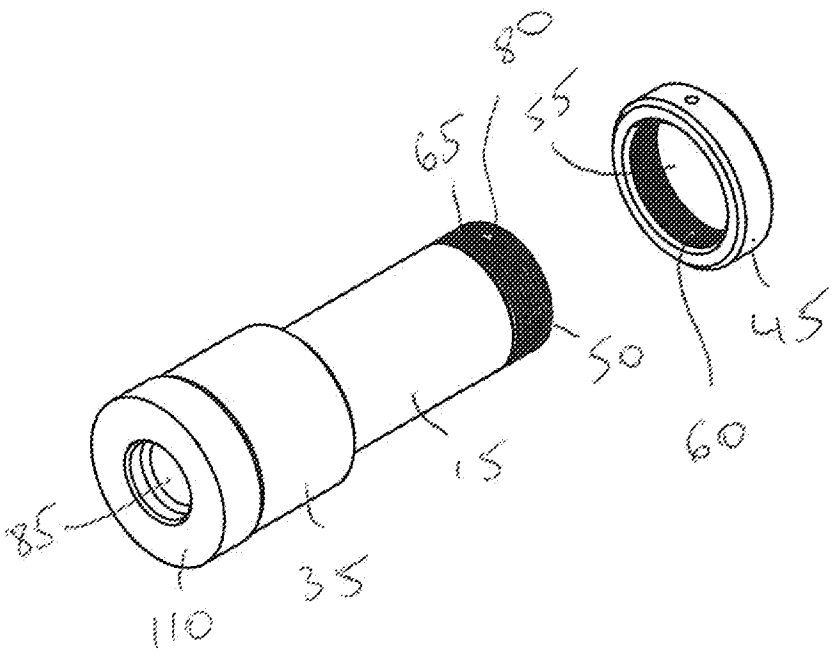
FIGS. 5-6 depict another portion of the buffer assembly according to some embodiments presently disclosed.

The buffer assembly 10 may also comprise a hammer 35. According to some embodiments, the hammer 35 is ring shaped. According to some embodiments, the hammer 35 is cylindrically shaped. The hammer 35 may comprise a through aperture 40 configured to accommodate the buffer body 15 as shown in FIG. 5. According to some embodiments, the hammer 35 is configured to move along at least a portion of the outer surface 30.

Figure 6:
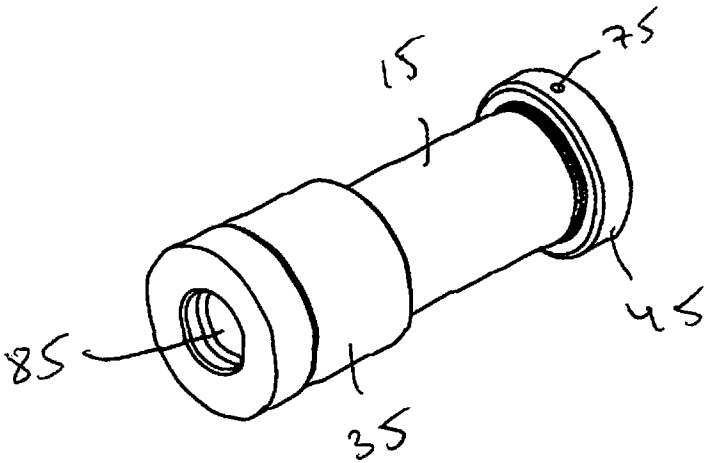

The buffer assembly 10 may also comprise a hammer retainer 45. According to some embodiments, the hammer retainer 45 is ring shaped. According to some embodiments, the hammer retainer 45 is cylindrically shaped. The hammer retainer 45 may be coupled with a first end 50 of the buffer body 15. The hammer retainer 45 may be removably coupled with a first end 50 of the buffer body 15. The hammer retainer 45 may comprise a through aperture 55 (shown in FIG. 5) configured to accommodate the buffer body 15 as shown in FIG. 6. According to some embodiments, the hammer retainer 45 comprises an inner thread 60 configured to mate with an outer thread 65 located along the outer surface 30 of the buffer body 15. According to some embodiments, the hammer retainer 45 may be coupled with the buffer body 15 using and/or placing retainer pin 70 through an aperture 75 and an aperture 80.

According to some embodiments, a second end 110 of the buffer body 15 comprises a cap 112. According to some embodiments, diameter of the cap 112 is larger than diameter of the outer surface 30. According to some embodiments, the cap 112 is integrally coupled with the outer surface 30. According to some embodiments, the cap 112 is integrally coupled with the buffer body 15. According to some embodiments, the cap 112 is removably coupled with the buffer body 15. According to some embodiments, the cap 112 and the buffer body 15 are a solid structure formed from the same material.

According to some embodiments, a second end 110 of the buffer body 15 comprises a protrusion 113 extending from the outer surface 30. According to some embodiments, diameter of the protrusion 113 is larger than diameter of the outer surface 30. According to some embodiments, the protrusion 113 comprises a circular outer diameter.

According to some embodiments, the hammer 35 is configured to move between the protrusion 113 and the hammer retainer 45 along at least a portion of the outer surface 30. According to some embodiments, the hammer 35 is configured to move between the protrusion 113 and the hammer retainer 45. According to some embodiments, the hammer 35 is configured to move between the cap 112 and the hammer retainer 45 along at least a portion of the outer surface 30. According to some embodiments, the hammer 35 is configured to move between the cap 112 and the hammer retainer 45. According to some embodiments, the cap 112 and the hammer retainer 45 retain the hammer 35 along at least a portion of the outer surface 30. According to some embodiments, the protrusion 113 and the hammer retainer 45 retain the hammer 35 along at least a portion of the outer surface 30. According to some embodiments, the hammer 35 is positioned between the protrusion 113 and the hammer retainer 45. According to some embodiments, the hammer 35 is positioned between the cap 112 and the hammer retainer 45. According to some embodiments, an inner diameter of the through aperture 40 of the hammer 35 is less than the outer diameter of the cap 112 and the outer diameter of the hammer retainer 45. According to some embodiments, an inner diameter of the through aperture 40 of the hammer 35 is less than the outer diameter of the protrusion 113 and the outer diameter of the hammer retainer 45.

Figure 7:
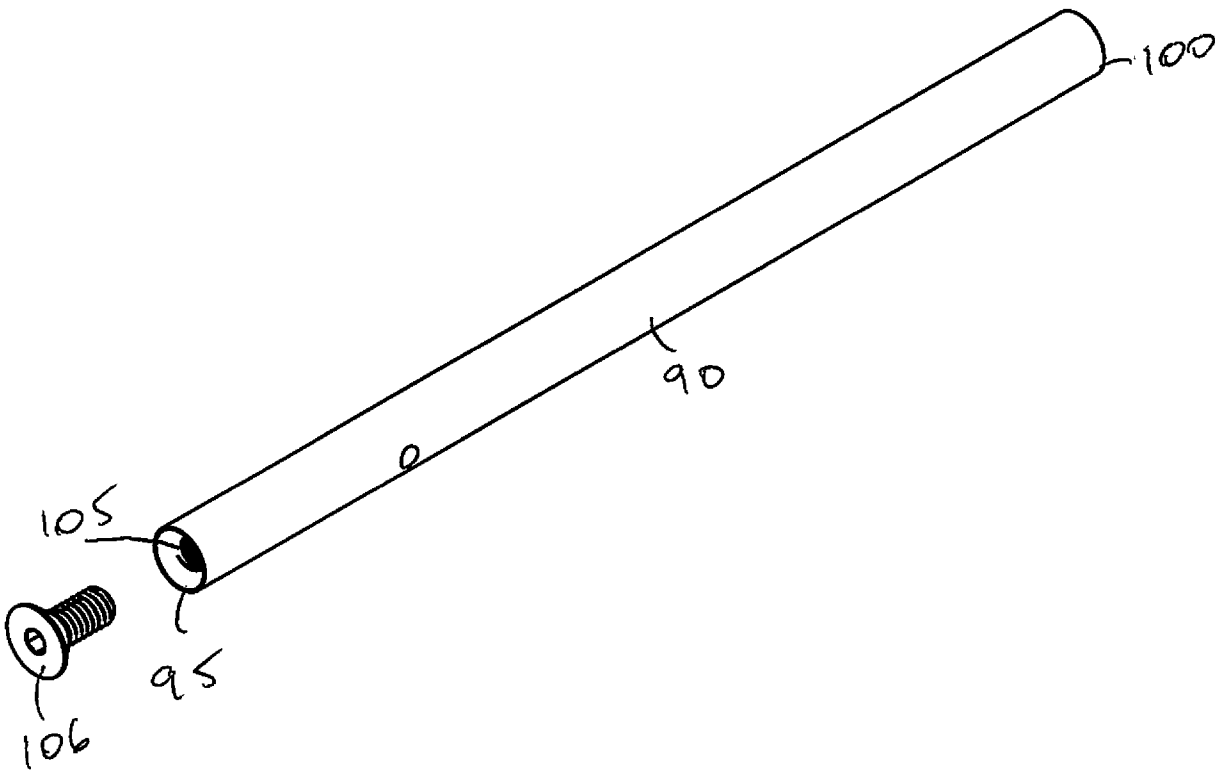
FIG. 7 depicts another portion of the buffer assembly according to some embodiments presently disclosed.
Figure 8:
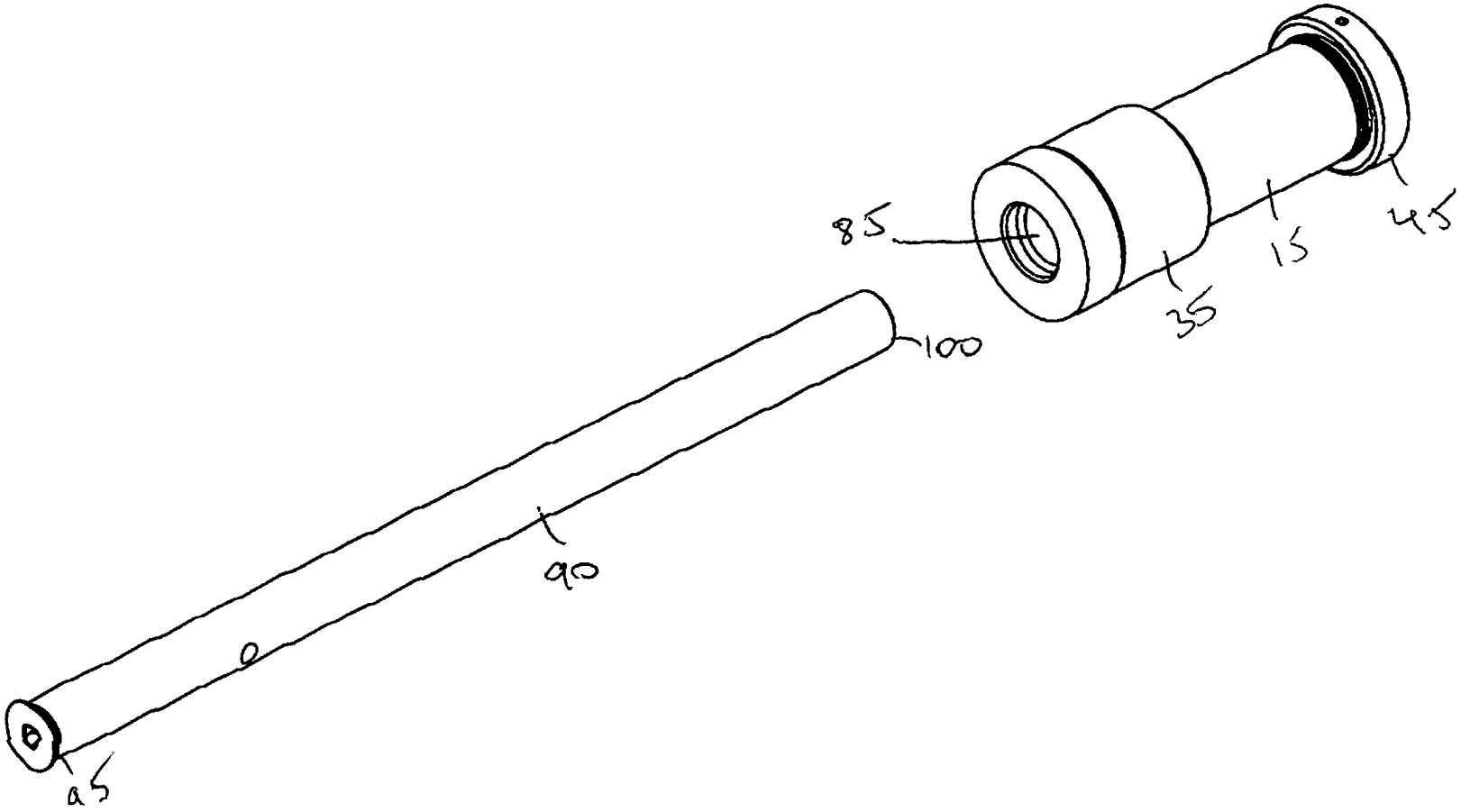
FIG. 8 depicts another portion of the buffer assembly according to some embodiments presently disclosed.

The buffer body 15 may comprise a through aperture 85 configured to accommodate a spring guide 90 shown in FIGS. 7-8. According to some embodiments, the spring guide 90 is a rod. According to some embodiments, the spring guide 90 is a hollow rod. According to some embodiments, the spring guide 90 is a solid rod. The spring guide 90 comprises a first end 95 and a second end 100. According to some embodiments, the first end 95 comprises an aperture 105 configured to accommodate a fastener 106. According to some embodiments, the second end 100 comprises an aperture (shown in FIGS. 14-16) configured to accommodate a fastener 107. According to some embodiments, the fastener 106 and/or 107 may be a pin, a screw, a bolt, a set screw, a full dog point set screw, or a dogleg set screw.

According to some embodiments, once the spring guide 90 is inserted through the aperture 85 of the buffer body 15, the fastener 106 is configured to prevent the second end 110 of the buffer body 15 to slide over the spring guide 90. According to some embodiments, the aperture 85 at the second end 110 is stepped to at least partially accommodate the fastener 106. According to some embodiments, the fastener 106 prevents the spring guide 90 from sliding out of the aperture 85. According to some embodiments, the fastener 106 prevents first end 95 of the spring guide 90 from sliding through the aperture 85. According to some embodiments, the fastener 106 prevents first end 95 of the spring guide 90 from sliding completely through the aperture 85.

Figure 9:
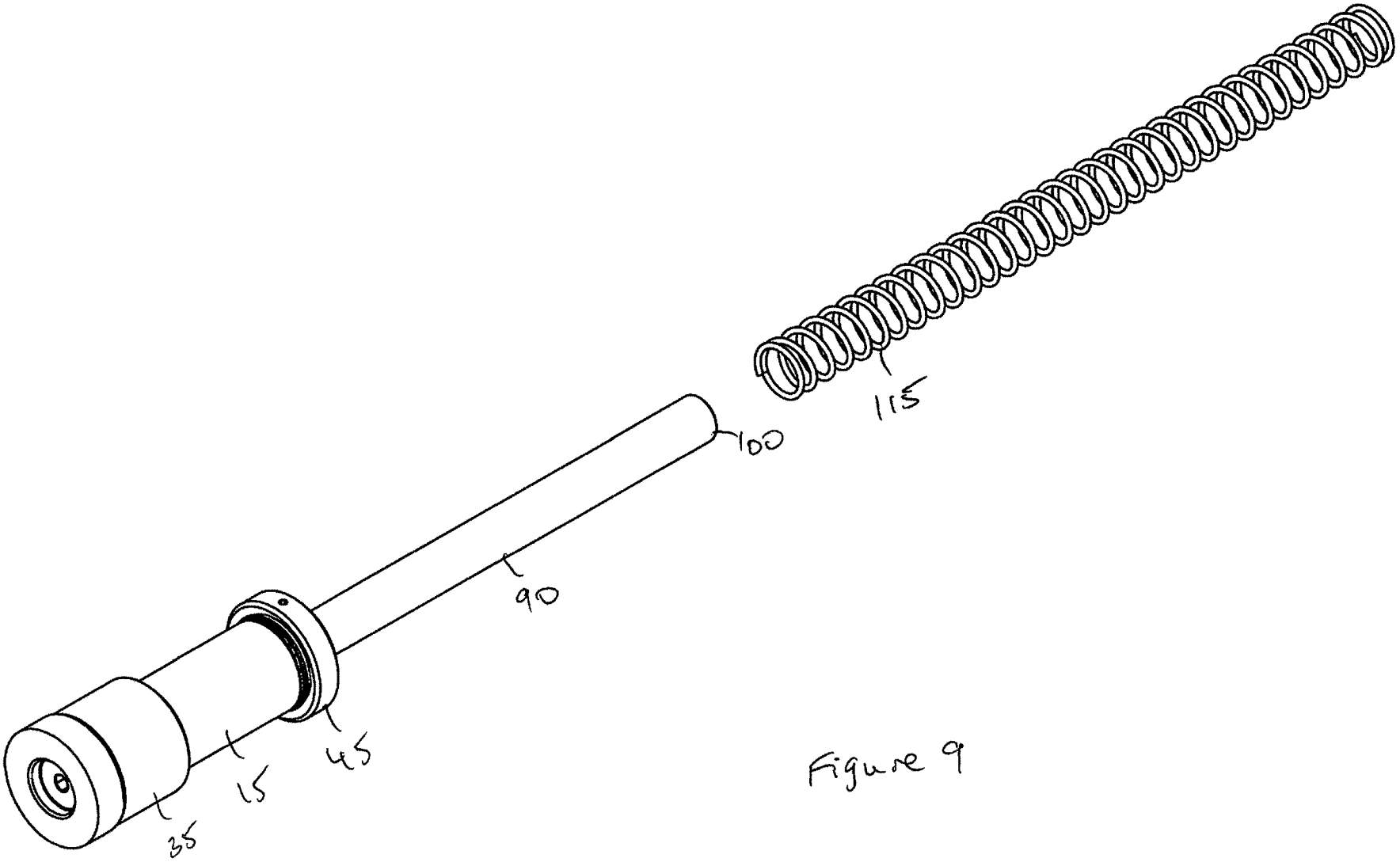
FIG. 9 depicts another portion of the buffer assembly according to some embodiments presently disclosed.
Figure 10:
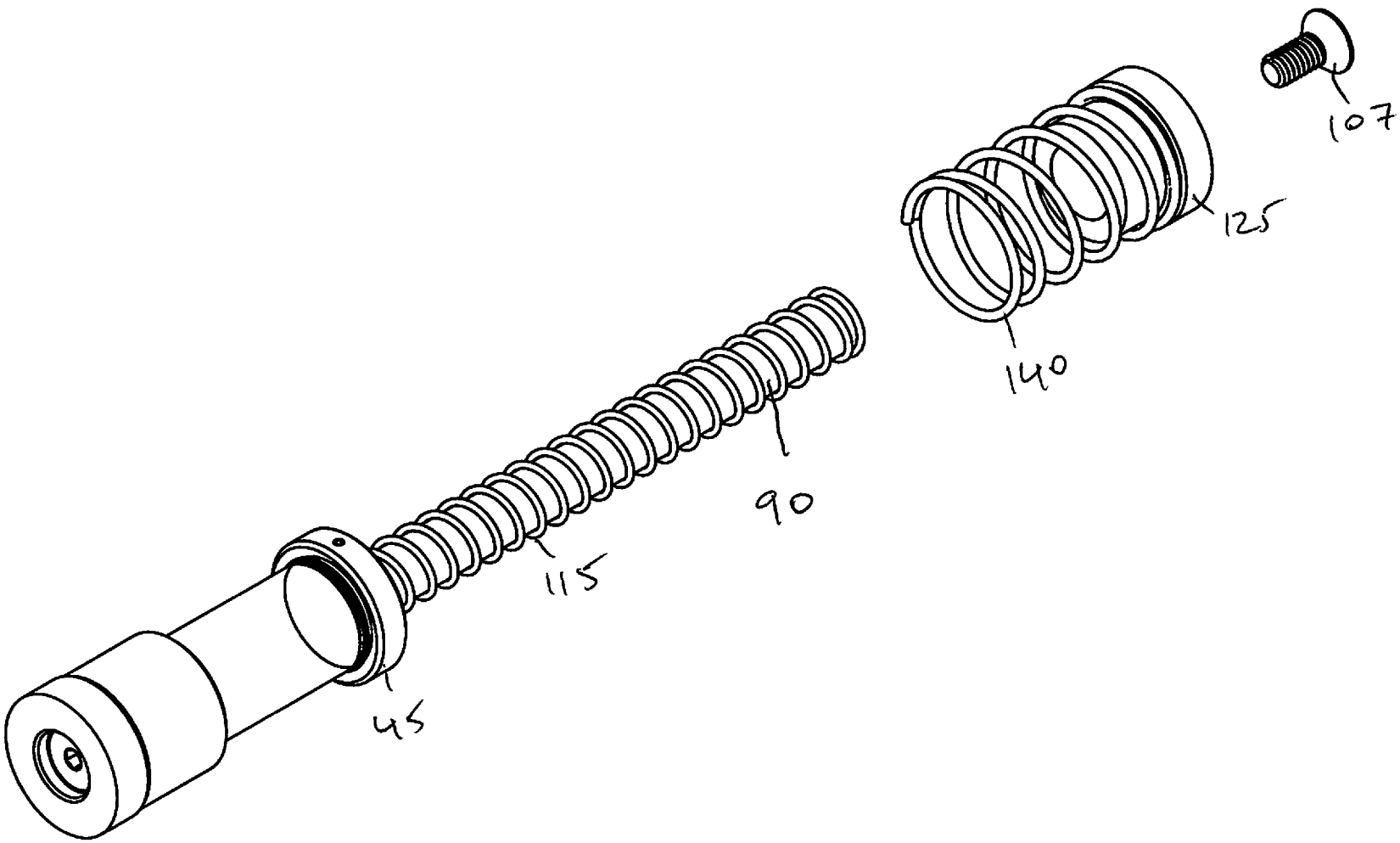
FIG. 10 depicts another portion of the buffer assembly according to some embodiments presently disclosed.

The buffer assembly 10 may also comprise a first spring 115 as shown in FIG. 9. According to some embodiments, the spring guide 90 passes through the first spring 115 as shown in FIG. 10. According to some embodiments, the first spring 115 abuts the hammer retainer 45 once the spring guide 90 passes through the first spring 115.

Figure 11:
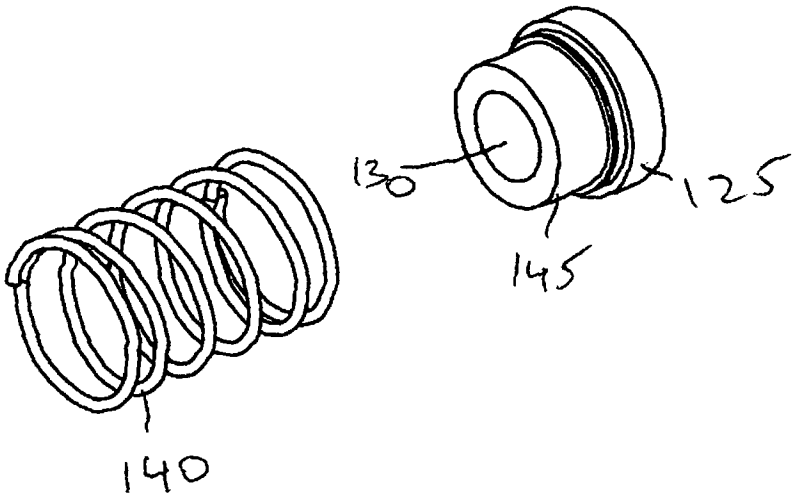
FIG. 11 depicts another portion of the buffer assembly according to some embodiments presently disclosed.

The buffer assembly 10 may also comprise an end cap 125 as shown in FIGS. 10-11. According to some embodiments, the end cap 125 comprises a through aperture 130 configured to accommodate the spring guide 90. According to some embodiments, the end cap 125 comprises a through aperture 130 configured to accommodate the second end 100 of the spring guide 90.

According to some embodiments, once the spring guide 90 is inserted through the aperture 130 of the end cap 125, the fastener 107 prevents the spring guide 90 from sliding out of the aperture 130. According to some embodiments, the fastener 107 prevents second end 100 of the spring guide 90 from sliding through the aperture 130. According to some embodiments, the fastener 107 prevents second end 100 of the spring guide 90 from sliding completely through the aperture 130. According to some embodiments, once the spring guide 90 is inserted through the aperture 130 of the end cap 125, the first spring 115 is positioned between the end cap 125 and the hammer retainer 45. According to some embodiments, once the spring guide 90 is inserted through the aperture 130 of the end cap 125, the first spring 115 is sandwiched between the end cap 125 and the hammer retainer 45.

Figure 13:
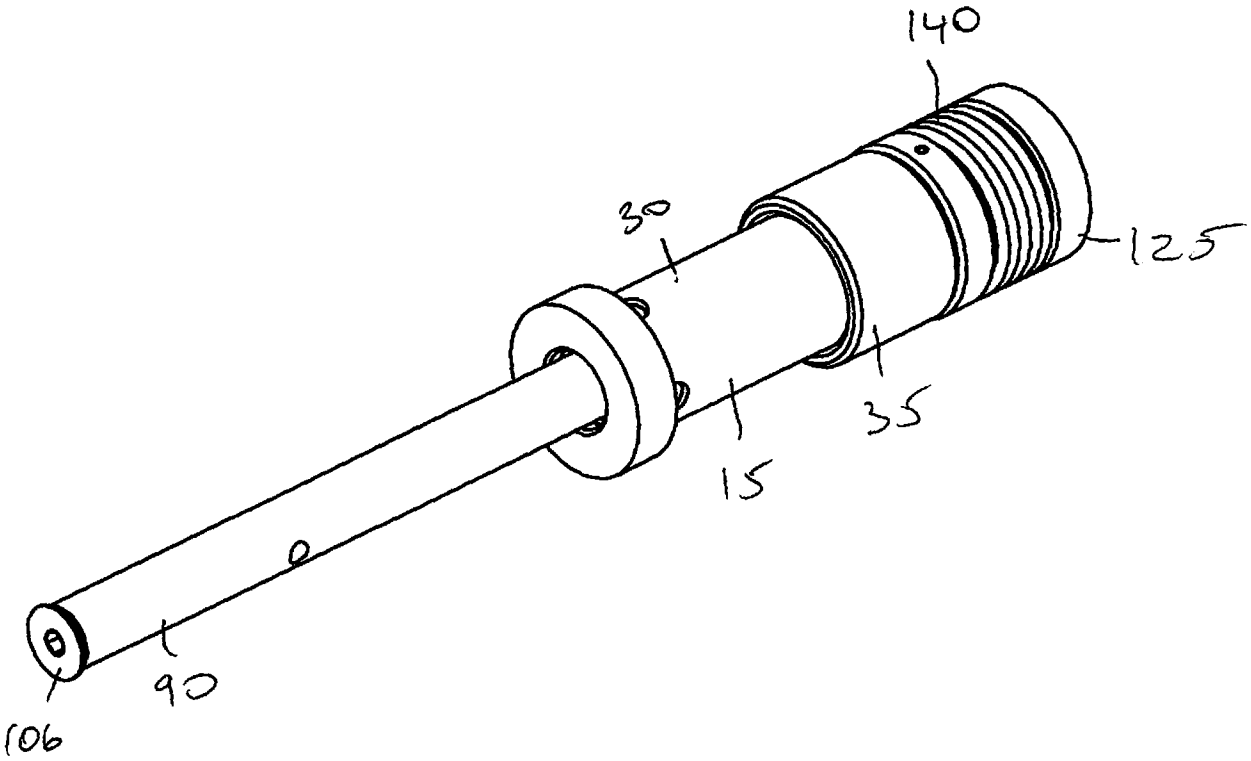
FIG. 13 depicts another portion of the buffer assembly according to some embodiments presently disclosed.

According to some embodiments presently disclosed, the buffer body 15 is configured to slide along the spring rod 90 between a first (i.e. forward) position (shown in FIG. 1) and a second (i.e. rear) position (shown in FIG. 13). According to some embodiments presently disclosed, the first (i.e. forward) position is position in which the buffer body 15 abuts the fastener 106. According to some embodiments presently disclosed, the first (i.e. forward) position is position in which the buffer body 15 is positioned adjacent to the first end 95 of the spring rod 90. According to some embodiments presently disclosed, the first (i.e. forward) position is position in which the cap 112 is positioned adjacent to the first end 95 of the spring rod 90. According to some embodiments presently disclosed, the first (i.e. forward) position is position in which the protrusion 113 is positioned adjacent to the first end 95 of the spring rod 90.

According to some embodiments presently disclosed, the second (i.e. rear) position is position other than the first (i.e. forward) position. According to some embodiments presently disclosed, the second (i.e. rear) position is position in which the buffer body 15 is positioned away from the first end 95 of the spring rod 90. According to some embodiments presently disclosed, the second (i.e. rear) position is position in which the cap 112 is positioned away from the first end 95 of the spring rod 90. According to some embodiments presently disclosed, the second (i.e. rear) position is position in which the protrusion 113 is positioned away from the first end 95 of the spring rod 90.

According to some embodiments presently disclosed, moving the buffer body 15 from the first (i.e. forward) position to the second (i.e. rear) position compresses the first spring 115 between the end cap 125 and the hammer retainer 45. According to some embodiments presently disclosed, the first spring 115 urges the buffer body 15 towards the first (i.e. forward) position.

According to some embodiments presently disclosed, the hammer 35 is configured to slide along the outer surface 30 of the buffer body 15 between a first (i.e. rest) position (shown in FIG. 1) and a second (i.e. end) position (shown in FIG. 13).

According to some embodiments presently disclosed, the first (i.e. rest) position is position in which the hammer 35 abuts the cap 112. According to some embodiments presently disclosed, the first (i.e. rest) position is position in which the hammer 35 abuts the protrusion 113. According to some embodiments presently disclosed, the first (i.e. rest) position is position in which a portion of the hammer 35 is positioned above the one or more magnets 20.

According to some embodiments presently disclosed, the second (i.e. end) position is position other than the first (i.e. rest) position. According to some embodiments presently disclosed, the second (i.e. end) position is position in which the hammer 35 is positioned away from the cap 112. According to some embodiments presently disclosed, the second (i.e. end) position is position in which the hammer 35 is positioned away from the protrusion 113. According to some embodiments presently disclosed, the second (i.e. end) position is position in which the hammer 35 is positioned away from the one or more magnets 20.

According to some embodiments presently disclosed, the one or more magnets 20 apply magnetic force to the hammer 35 to prevent the hammer 35 from moving to the second (i.e. end) position. According to some embodiments presently disclosed, the one or more magnets 20 apply magnetic force to the hammer 35 to keep the hammer 35 in the first (i.e. rest) position.

According to some embodiments presently disclosed, the buffer assembly 10 may also comprise a second spring 140 as shown in FIGS. 1 and 10-11. According to some embodiments, the spring guide 90 passes through the second spring 140 as shown in FIG. 1. According to some embodiments, the spring guide 90 and the first spring 115 pass through the second spring 140 as shown in FIG. 1.

Figure 12:
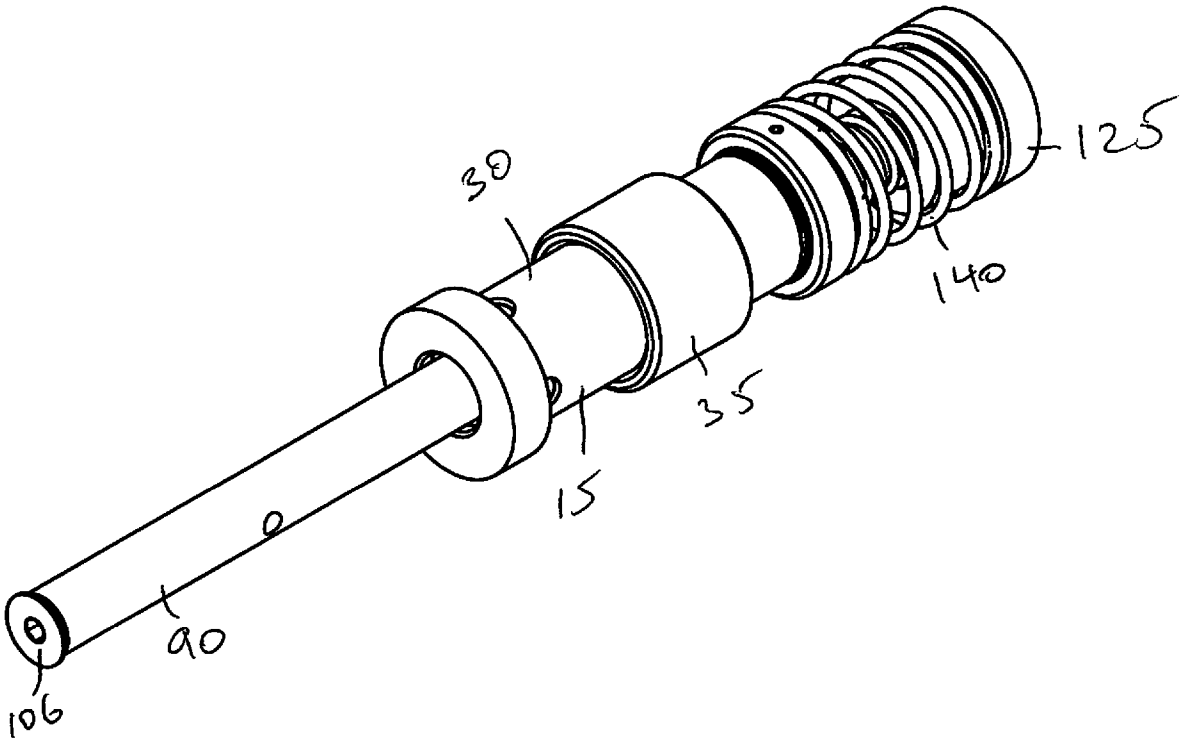
FIG. 12 depicts another portion of the buffer assembly according to some embodiments presently disclosed.

According to some embodiments presently disclosed, moving the buffer body 15 from the first (i.e. forward) position to the second (i.e. rear) position compresses the first spring 115 and the second spring 140 between the end cap 125 and the hammer retainer 45 (shown in FIGS. 12-13). According to some embodiments presently disclosed, the first spring 115 and the second spring 140 urge the buffer body 15 towards the first (i.e. forward) position.

Figure 14:
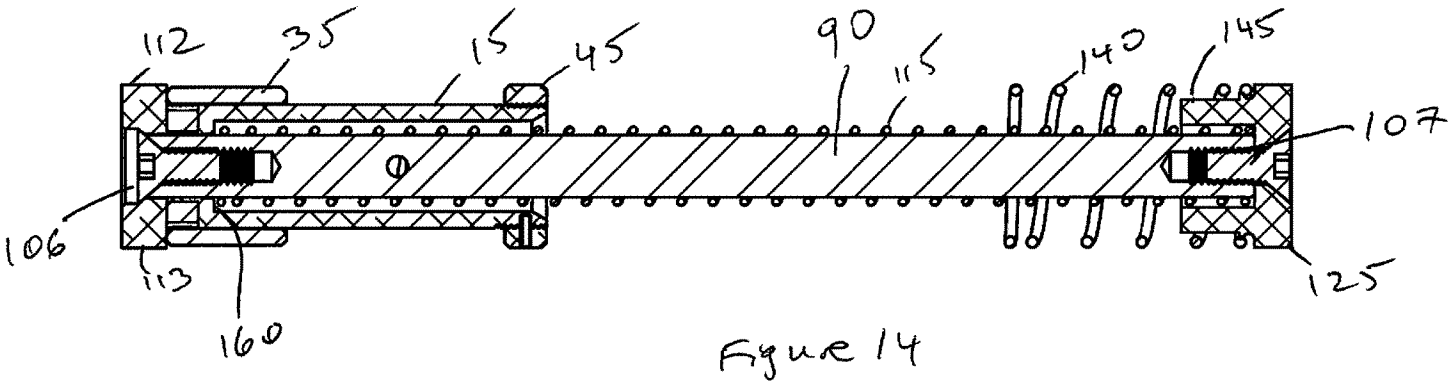
FIG. 14 depicts a cut away view of the buffer assembly according to some embodiments presently disclosed.
Figure 15:
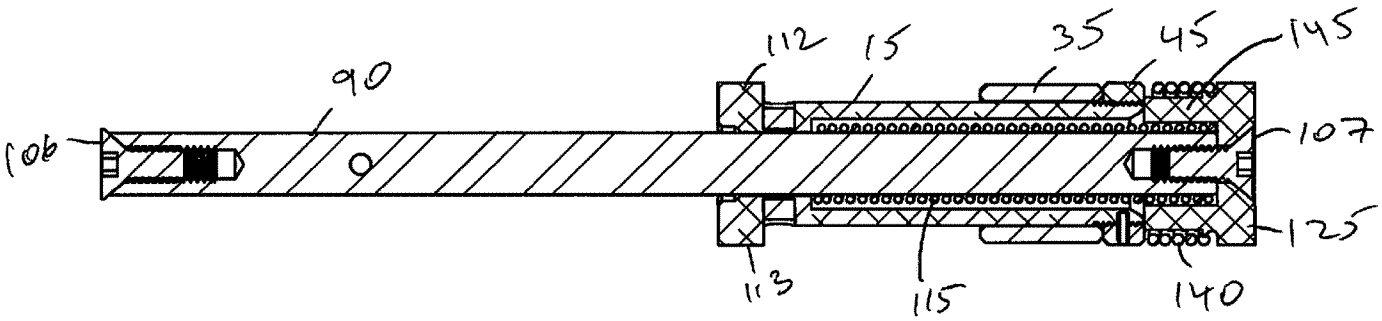
FIG. 15 depicts another cut away view of the buffer assembly according to some embodiments presently disclosed.
Figure 16:
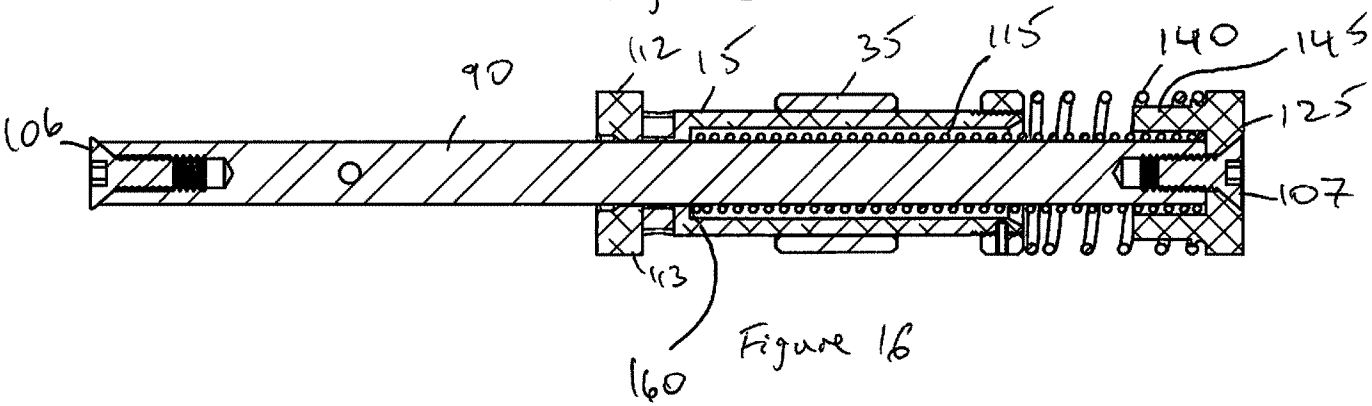
FIG. 16 depicts another cut away view of the buffer assembly according to some embodiments presently disclosed.

According to some embodiments, the end cap 125 comprises a protrusion 145 According to some embodiments, a portion of the second spring 140 is positioned over the protrusion 145 (shown in FIG. 10). According to some embodiments, the protrusion 145 is configured to keep the second spring 140 adjacent to the end cap 125 (shown in FIG. 10). According to some embodiments, the protrusion 145 is configured to keep the second spring 140 from sliding along the spring guide 90 and/or along the first spring 115 when the buffer body 15 is in the first (i.e. forward) position. (shown in FIGS. 1 and 14). According to some embodiments presently disclosed, moving the buffer body 15 from the first (i.e. forward) position to the second (i.e. rear) position compresses the second spring 140 above the protrusion 145 as shown in FIGS. 14-16. According to some embodiments presently disclosed, the protrusion 145 is positioned between the first spring 115 and the second spring 140 as shown in FIGS. 14-16.

According to some embodiments, the aperture 85 is configured to accommodate the spring rod 90 and at least a portion of the first spring 115 as shown in cutaway FIGS. 14-16. According to some embodiments, the aperture 85 comprises an inner step 160 as shown in FIGS. 14-16. According to some embodiments presently disclosed, moving the buffer body 15 from the first (i.e. forward) position to the second (i.e. rear) position compresses the first spring 115 between the inner step 160 and the end cap 125. According to some embodiments presently disclosed, the first spring 115 is positioned within the aperture 85 and within the protrusion 145 when the buffer body 15 is in the second (i.e. rear) position as shown in FIGS. 14-16.

Figure 17:
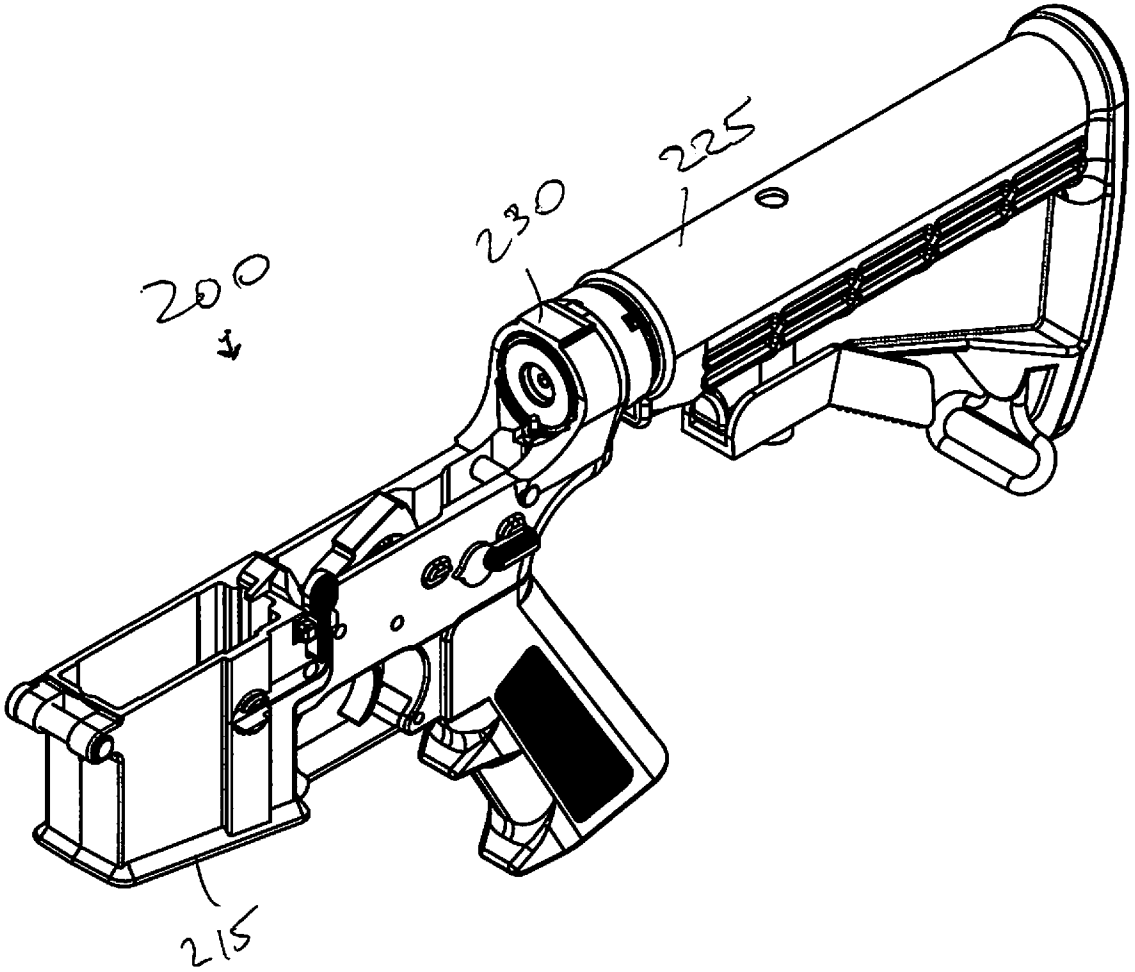
FIG. 17 depicts a partial view of a firearm according to some embodiments presently disclosed.
Figure 18:
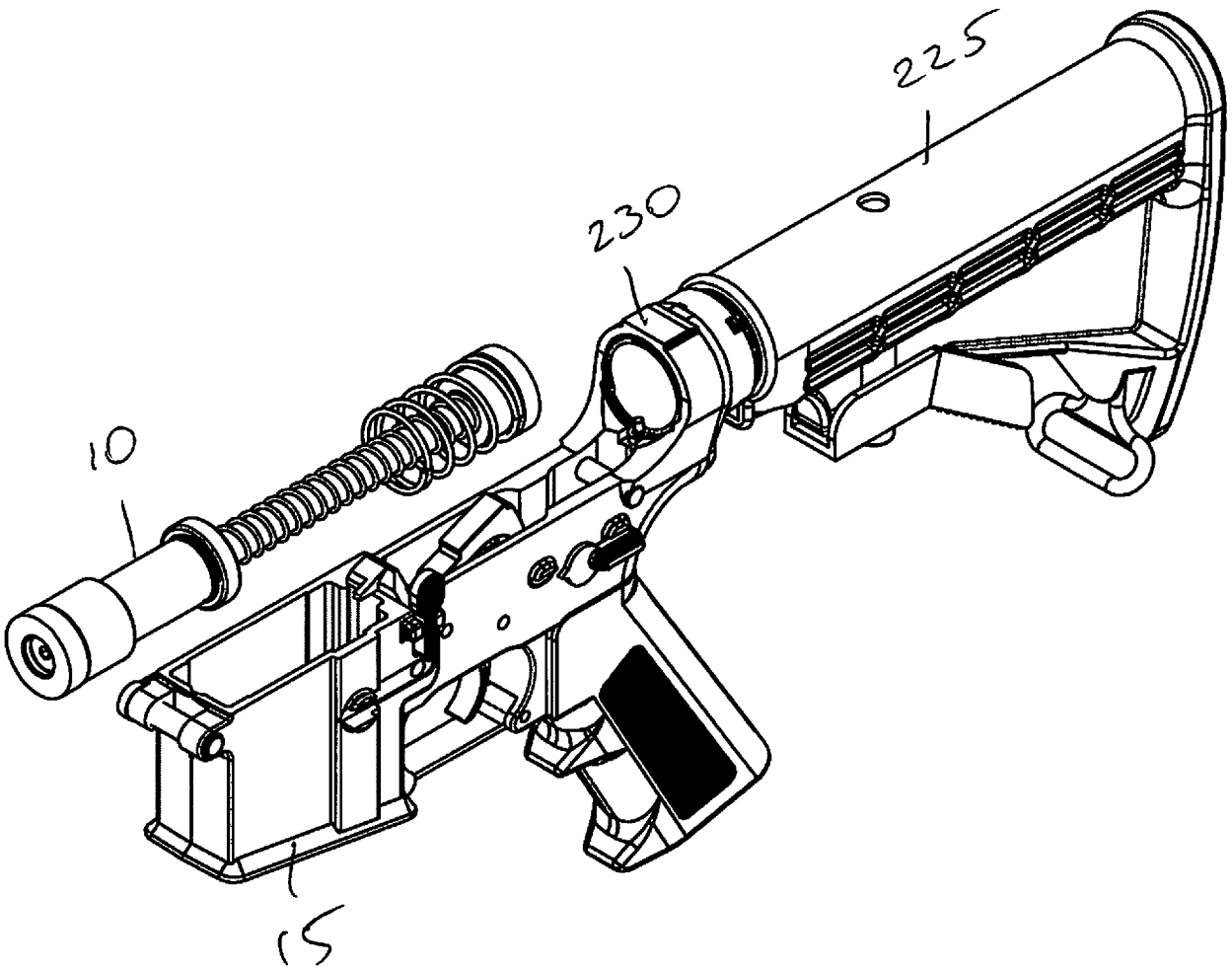
FIG. 18 depicts an exploded partial view of the firearm according to some embodiments presently disclosed.

Referring to FIG. 17, a portion of a firearm 200 is shown according to some embodiments presently disclosed. The firearm 200 may comprise a lower receiver 215. Referring to FIG. 18, an exploded view of the buffer assembly 10 and the firearm 200 is shown according to some embodiments presently disclosed.

Figure 19:
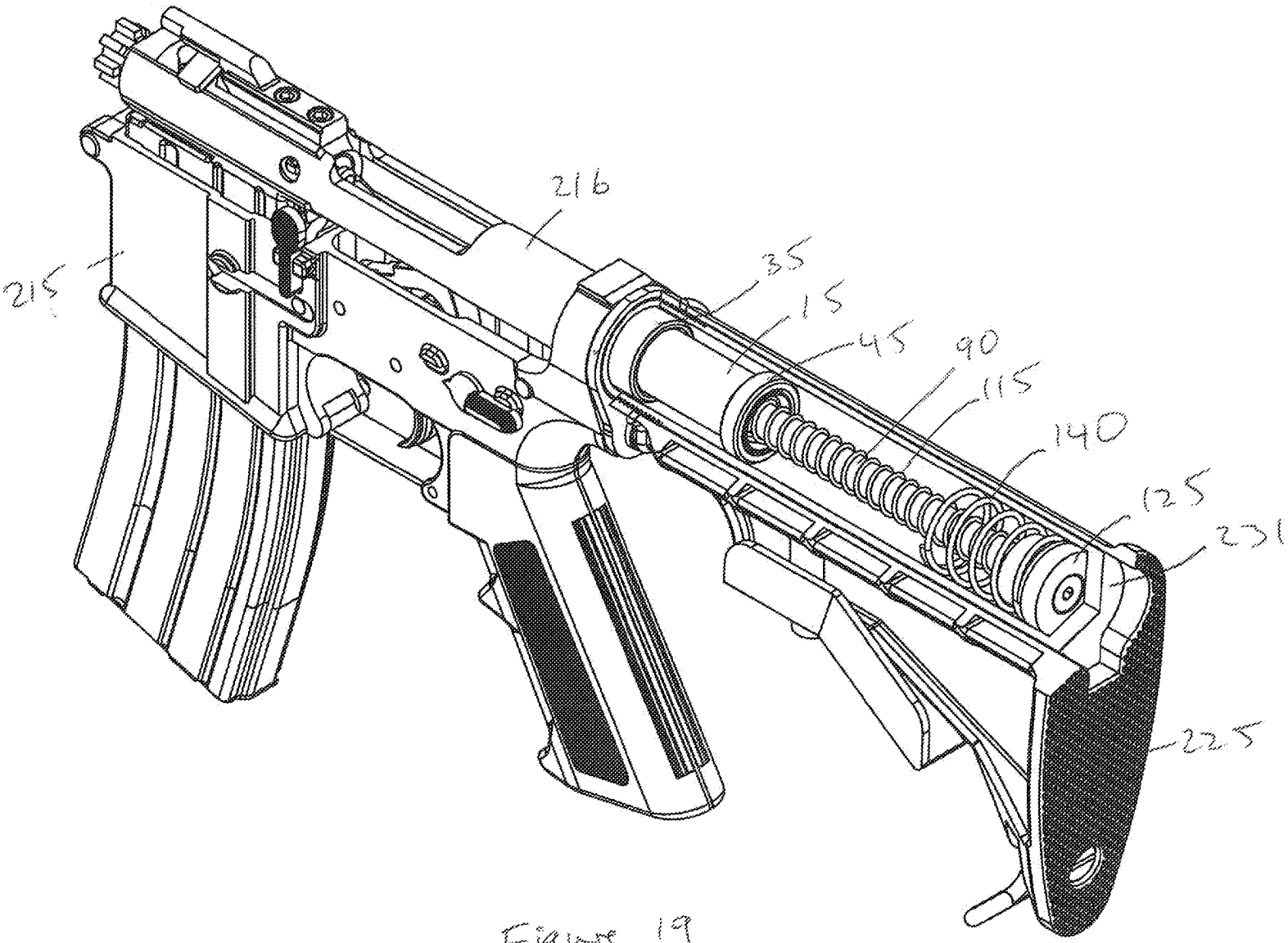
FIG. 19 depicts a cut away view of the firearm according to some embodiments presently disclosed.
Figure 20:
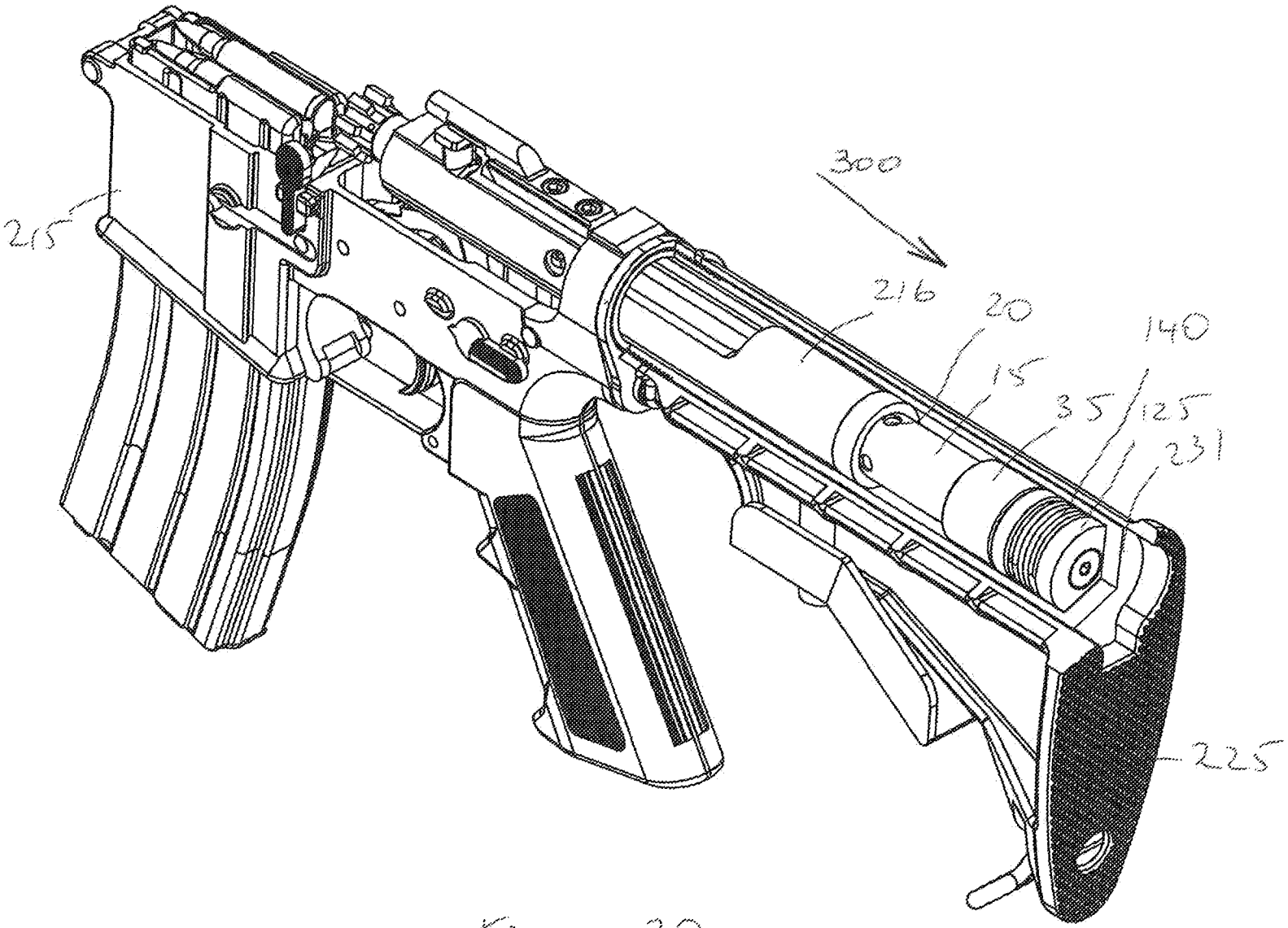
FIG. 20 depicts another cut away view of the firearm according to some embodiments presently disclosed.
Figure 21:
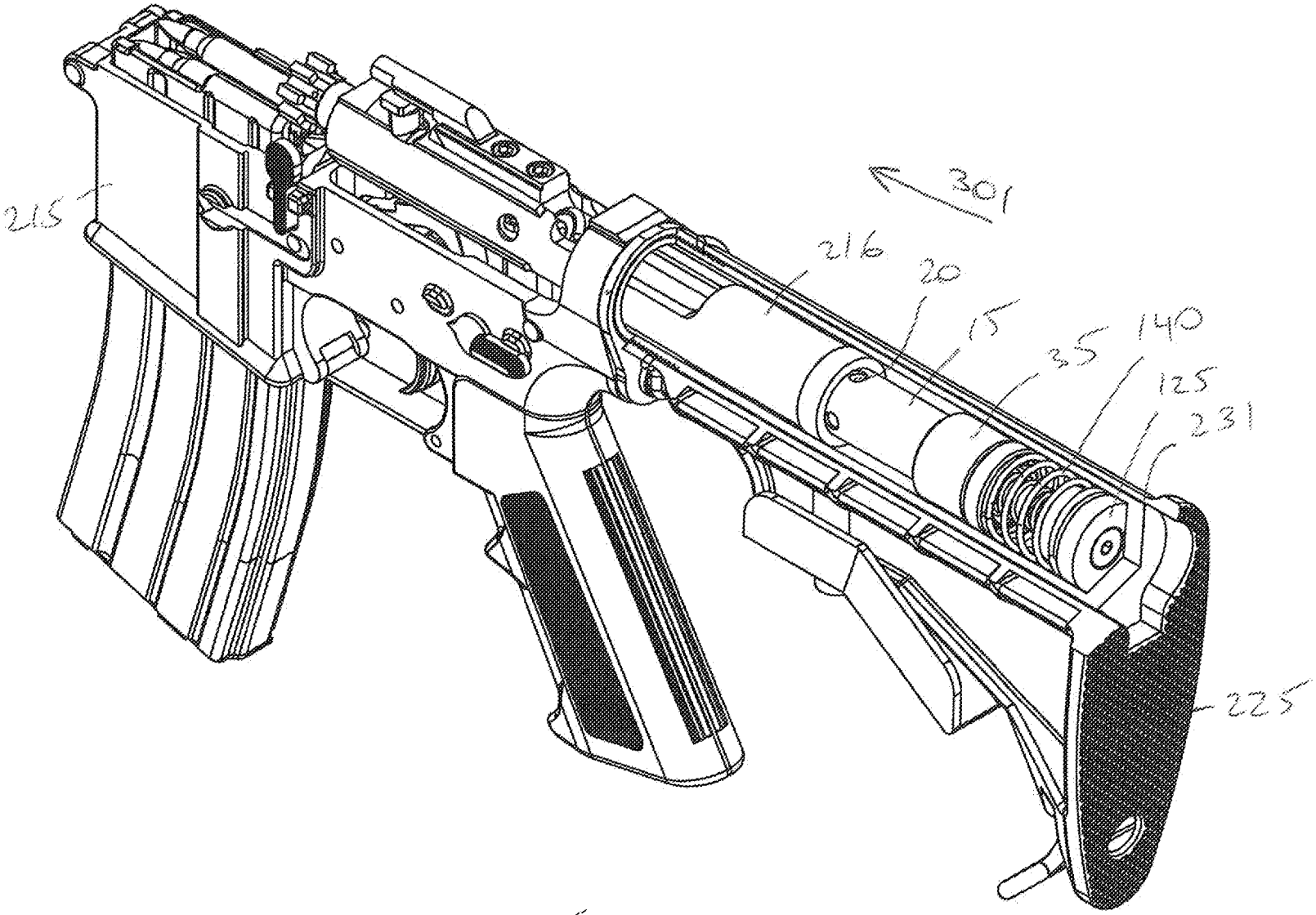
FIG. 21 depicts another cut away view of the firearm according to some embodiments presently disclosed.

The lower receiver 215 comprises an upwardly extending lobe 330. According to some embodiments, the upwardly extending lobe 230 is used to mount a buttstock 225 to the lower receiver 215 and is used to align a receiver extension (i.e. buffer tube) 231 with a bolt carrier 216 housed within an upper receiver (not shown). The receiver extension 231 is configured to accommodate the buffer assembly 10 as shown in FIGS. 19-21. Upon discharge of a round, the bolt carrier 216 within the upper receiver is driven rearward by action of the gas discharged by the firing action. The buffer assembly 10 dampens the kickback experienced by a user while also redirecting the firing mechanism back toward the chamber in preparation for firing another round.

Referring to FIG. 19, when firearm 200 is ready to discharge a round, the bolt carrier 216 is in battery, the buffer body 15 is in the first (i.e. forward) position and the hammer 35 is in the first (i.e. rest) position according to some embodiments presently disclosed. When the firearm 200 is ready to discharge a round, the hammer 35 is retained in the first (i.e. rest) position by the one or more magnet 20. According to some embodiments, the magnetic forces of the one or more magnets 20 prevent the hammer 35 from sliding along the outer surface 30 of the buffer body 15 when the firearm 200 is ready to discharge a round. According to some embodiments, the hammer 35 comprises metal material. When the firearm 200 is ready to discharge a round, the buffer body 15 is retained in the first (i.e. forward) position by the first spring 115.

Referring to FIG. 20, upon discharge of the round, the bolt carrier 216 within the upper receiver is driven rearward by action of the gas discharged by the firing action in direction 300. This action by the bolt carrier 216 causes rear portion of the bolt carrier 216 to drive the buffer body 15 rearward to the second (i.e. rear) position against the force exerted by the first spring 115. This further causes the hammer 35 to overcome the magnetic forces exerted by the one or more magnets 20 and to move rearward to the second (i.e. end) position. According to some embodiments presently disclosed, the hammer 35 overcomes the magnetic forces exerted by the one or more magnets 20 when the buffer body 15 is in the second (i.e. rear) position. According to some embodiments presently disclosed, the hammer 35 overcomes the magnetic forces exerted by the one or more magnets 20 when the first spring 115 is fully compressed. According to some embodiments presently disclosed, the hammer 35 overcomes the magnetic forces exerted by the one or more magnets 20 when the first spring 115 and the second spring 140 are fully compressed. According to some embodiments presently disclosed, the hammer 35 overcomes the magnetic forces exerted by the one or more magnets 20 when the buffer body 15 is at the furthest possible away from the first end 95 of the spring guide 90.

According to some embodiments presently disclosed, the bolt carrier 216 comprises an aperture configured to accommodate the first end 95 of the spring guide 90 as the bolt carrier 216 is driven rearward in the direction 300. According to some embodiments presently disclosed, the bolt carrier 216 comprises an aperture configured to accommodate at least a portion of the spring guide 90 as the bolt carrier 216 is driven rearward in the direction 300.

Referring to FIG. 21, after the buffer assembly 10 dampens the kickback experienced by a user, the buffer assembly 10 redirects the bolt carrier 216 back toward the chamber (direction 301) in preparation for firing another round. According to some embodiments presently disclosed, during this action of redirecting the bolt carrier 216 back toward the chamber, the first spring 115 urges the buffer body 15 back to the first (i.e. forward) position in direction 301. According to some embodiments presently disclosed, during this action of redirecting the bolt carrier 216 back toward the chamber, the first spring 115 and the second spring 140 both urge the buffer body 15 back to the first (i.e. forward) position in direction 301. This further causes the hammer 35 to move in direction 301 towards the first (i.e. rest) position where the hammer 35 can be held in place by the magnetic forces exerted by the one or more magnets 20.

According to some embodiments presently disclosed, the hammer 35 starts to move in direction 301 towards the first (i.e. rest) position when the buffer body 15 is in the first (i.e. forward) position. According to some embodiments presently disclosed, the hammer 35 reaches the first (i.e. rest) position after the buffer body 15 reaches in the first (i.e. forward) position.

According to some embodiments, direction 301 is opposite direction 300.

According to some embodiments, the hammer 35 weighs between 0.5 oz and 2.5 oz. According to some embodiments, the hammer 35 weighs 0.85 oz. According to some embodiments, the hammer 35 weighs 2.2 oz.

It is to be understood that the buffer assembly 10 described above may be implemented on different types of firearms. The buffer assembly 10 described above may be implemented on firearms using a blowback system of operation, and/or firearm using a direct impingement system of operation, and/or firearm using piston system of operation. Blowback is a system of operation for self-loading firearms that obtains energy from the motion of the cartridge case as it is pushed to the rear by expanding gas crated by the ignition of the propellant charge. Direct impingement is a type of gas operation for a firearm that directs gas from a fired cartridge directly into the bolt carrier to cycle the action. Piston system uses gas pressure to mechanically move the bolt carrier to cycle the action. It is also to be understood that the buffer assembly 10 described above may be implemented on M-16 and Armalite style rifles (ARs).

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one"

unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. A buffer assembly comprising:

a buffer body comprising a first through aperture and an outer surface;

a plurality of magnets positioned along the outer surface of the buffer body;

a hammer comprising a second though aperture, wherein the buffer body is positioned within the second through aperture, wherein the hammer is configured to move between a rest position and an end position along the buffer body, wherein the plurality of magnets are positioned between the buffer body and the hammer when the hammer is in the rest position;

a first spring at least partially positioned within the first though aperture of the buffer body;

a spring guide at least partially positioned within the first spring and at least partially positioned within the first through aperture of the buffer body, wherein the buffer body is configured to move between a forward position and a rear position along the spring guide; and an end cap removably coupled with the spring guide;

wherein the buffer body comprises a plurality of apertures positioned along the outer surface of the buffer body; wherein the plurality of apertures are configured to accommodate the plurality of magnets.

2. The buffer assembly of claim 1 further comprising a hammer retainer coupled with the buffer body.

3. The buffer assembly of claim 1 further comprising a second spring, wherein the first spring and the spring guide are positioned within the second spring.

4. The buffer assembly of claim 1 further comprising:

a first fastener coupled with a first end of the spring guide to prevent the first end of the spring guide from sliding though the first through aperture; and a second fastener coupling the end cap with the second end of the spring guide.

5. The buffer assembly of claim 1, wherein the plurality of magnets are positioned equidistantly along the outer surface of the buffer body.

6. The buffer assembly of claim 1, wherein the hammer is cylindrical shape.

7. The buffer assembly of claim 1, wherein the spring guide is hollow rod.

8. The buffer assembly of claim 1, wherein the spring guide is solid rod.

9. The buffer assembly of claim 1, wherein the hammer is positioned away from the plurality of magnets when the hammer is in the end position.

* * * * *